US008371645B2

(12) United States Patent
Lin et al.

(10) Patent No.: US 8,371,645 B2
(45) Date of Patent: Feb. 12, 2013

(54) MECHANISM FOR SELF FOLDING UP AND CUSHING A SEAT OF PORTABLE CHAIR

(76) Inventors: Mei Chuen Lin, Taoyuan (TW); Tzu Mei Wang, Taoyuan (TW)

( * ) Notice: Subject to any disclaimer, the term of this patent is extended or adjusted under 35 U.S.C. 154(b) by 170 days.

(21) Appl. No.: 13/014,713

(22) Filed: Jan. 26, 2011

(65) Prior Publication Data

US 2012/0187733 A1 Jul. 26, 2012

(51) Int. Cl.
*A47C 4/00* (2006.01)

(52) U.S. Cl. ..... 297/23; 297/56; 297/332; 297/463.1

(58) Field of Classification Search ..... 297/23, 297/56, 58, 332, 463.1, 463.2, 239
See application file for complete search history.

(56) References Cited

U.S. PATENT DOCUMENTS

| | | | | |
|---|---|---|---|---|
| 5,527,097 | A * | 6/1996 | Martin | 297/463.1 |
| 7,219,955 | B2 * | 5/2007 | Lu et al. | 297/58 |
| 7,427,099 | B1 * | 9/2008 | Lin et al. | 297/56 |
| 2009/0189045 | A1 * | 7/2009 | Peckovich | 248/345.1 |

* cited by examiner

*Primary Examiner* — David Dunn
*Assistant Examiner* — Alexander Harrison
(74) *Attorney, Agent, or Firm* — Lin & Associates IP, Inc.

(57) ABSTRACT

A portable chair has a mechanism for self folding up and cushioning a seat. The mechanism includes a tension spring assembled between a seat frame and a rear leg for collapsing the seat, and a cushioning pad affixed on the rear leg. The tension spring has first and second hook elements disposed on different orientations and engaged with holes. The hook elements are easy to install, and reduce the risk of disengagement after assembly. The length of the spring is substantially equal to the length of the space in which it is assembled, so that it is not excessively stretched during assembly, thereby preventing spring fatigue. The cushioning pad is integrally formed and includes retainer and insert portions through which it is affixed with the rear leg, and a cushion portion that can absorb noise and vibration when the seat is collapsed.

11 Claims, 10 Drawing Sheets

MECHANISM FOR SELF FOLDING UP AND CUSHING A SEAT OF PORTABLE CHAIR

BACKGROUND OF THE INVENTION

1. Field of the Invention

The present invention generally relates to a mechanism for a portable chair which can self fold up and absorb impact as the seat is folded up.

2. The Prior Arts

A conventional portable chair usually includes a set of joining hinges mounted between the seat frame and the front legs at the left and right sides of the seat frame, which allows folding and unfolding of the seat. For collapsing the chair, a user can manually pivot the seat to a folded state lying substantially parallel to the legs of the chair. Because the manual folding may not be convenient to operate, certain portable chairs may be provided with a self-folding mechanism, as shown in FIG. 8. The self-folding mechanism has hanging holes A1 and B1 respectively through a mount bracket A on the seat frame and a restricting flange B on the rear leg, and engaging first and second hook elements C1 and C2 of a tension spring C with the hanging holes A1 and B1. When the seat is unfolded, the tension spring C is stretched to accumulate a spring force. When the seat is released, the spring force makes the seat be folded into a collapsed state.

The conventional tension spring C includes coils and the two hook elements C1, C2 extended from the two ends of the coils. Each of the hook elements is extended from a central axis of the tension spring C as shown in FIG. 8, and has a curved shape. The first and second hook elements C1 and C2 are aligned in a straight line. Moreover, the length of the spring is usually shorter than the space in which the spring is assembled. Accordingly, the spring has to be substantially stretched to engage its two hook elements with the corresponding hanging holes, and therefore the spring is always in a loaded state even when the seat is collapsed. As a result, when the seat is collapsed from the unfolded state, the resilient force loaded in the spring (including the initial spring stretching force when the spring is assembled and the resilient force accumulated when the seat is unfolded) is substantially greater than necessary, which may cause fatigue and permanent deformation of the spring. Because the deformed spring has a greater length, the hook elements C1 and C2 may easily disengage from the hanging holes A1 and B1, causing failure of the self-folding mechanism.

Moreover, the excessive spring force applied on the seat may cause substantial noise and vibration when the steel-made seat frame collides against the rear legs.

SUMMARY OF THE INVENTION

One of objectives of the present invention is to provide an improved tension spring structure used in a mechanism for self folding a portable chair. The improved construction can address the aforementioned problems related to spring fatigue and disengagement.

Another objective of the present invention is to provide an improved tension spring structure with two hook elements that are arranged in different orientations, can easily engage with two hanging holes on different planes, and do not disengage once connected with the hanging holes.

Still another objective of the present invention is to provide a cushion pad mounted on a frame edge of the rear leg. The cushion pad can absorb vibration and noise that may occur when the seat, driven by the tension spring, is folded to the collapsed state.

In order to accomplish the above objectives, the present invention provides a mechanism for folding up and cushioning a seat of a portable chair. The mechanism comprises a tension spring having a first hook element and a second hook element. The first hook element includes a first extension that is parallel to a spring axis and extends from an edge of coils of the spring toward a distal end terminating into a curved first hook. The second hook element includes a second extension that extends from an edge of coils in a direction perpendicular to the spring axis and has a distal end that is joined with a perpendicular second hook. The first and second hook elements are respectively engaged with a first and second hanging hole provided on a mount bracket of the seat and a restricting flange of a rear leg. The coils of the tension spring extend over a length that is substantially equal to the distance between the first and second hanging holes.

The first and second hook elements can be engaged with the first and second hanging holes disposed on planes that are not parallel to each other, and can be entirely restrained in position to prevent disengagement from the hanging holes. The spring can be bent to align and engage the second hook with the second hanging hole, which is more convenient to install and attach than the conventional tension spring. Moreover, the coils of the tension spring extend over a length that is substantially equal to the length of the space in which the tension spring is assembled. When the seat is lifted to the collapsed state, the tension in the tension spring is substantially smaller than the tension in the conventional tension spring having shorter coils. Thus, fatigue and related deformation problems would not happen, which prevents disengagement of the tension spring.

Additionally, the mechanism comprises an integrally-formed cushioning pad including a retainer portion, an insert portion and a cushion portion. The retainer portion has an opened side for engagement with the rear leg, the cushion portion has two hollow lobes that are joined adjacently on the retainer portion, the retainer portion is wrapped around a frame edge of the rear leg, and the insert portion is inserted into a groove of the rear leg for affixing the cushioning pad on the rear leg.

When the seat driven by the tension spring is folded up to the collapsed state, the seat frame can collide against the cushion portion, which squeezes the lobes of the cushion portion to absorb noise and vibration.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
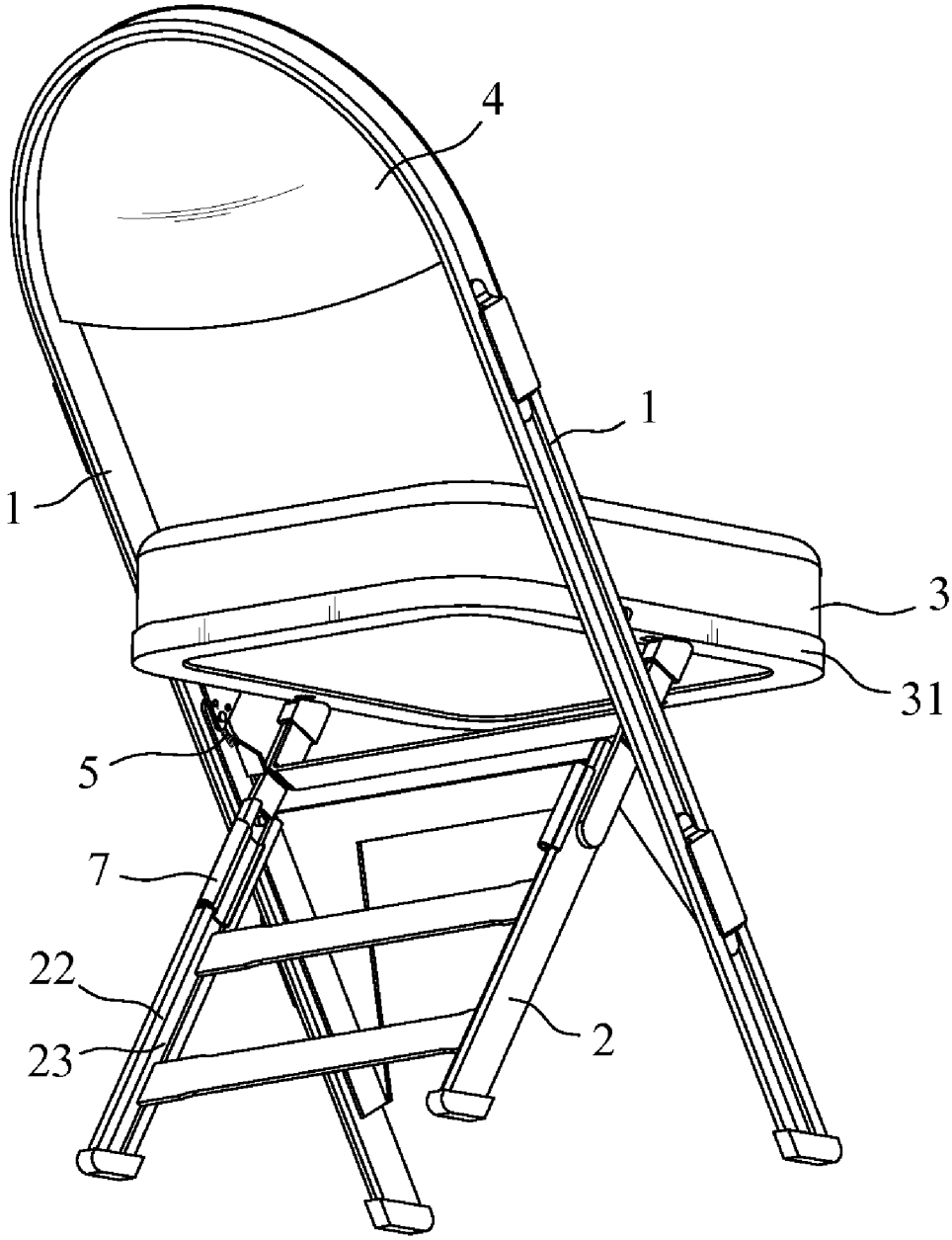
FIG. 1 is a rear perspective view showing a portable chair according to an embodiment of the present invention in an unfolded state.

Referring to FIG. 1, a portable chair according to an embodiment of the present invention comprises front and rear legs 1 and 2 pivotally connected with each other, and a back rest 4. Inner sides of the front legs 1 are pivotally connected with a seat 3 that can be rotated and folded to collapse the entire chair in a substantially planar configuration easy for storage. A mechanism for self folding up and cushioning a seat of the portable chair according to the present invention includes a self-folding mechanism that can automatically fold up the seat 3, and a cushion mechanism that prevents the seat 3 from violently colliding against the rear legs 2 and producing annoying noise and vibration.

The self-folding mechanism comprises a tension spring 5 that is coupled between a bottom of the seat frame 31 and the rear legs 2. When the seat 3 is unfolded horizontal, the tension spring 5 can be loaded with a spring force. When an external pressure on the seat 3 is released, the spring force can lift the seat 3 to a collapsed position parallel with the legs.

Figure 2:
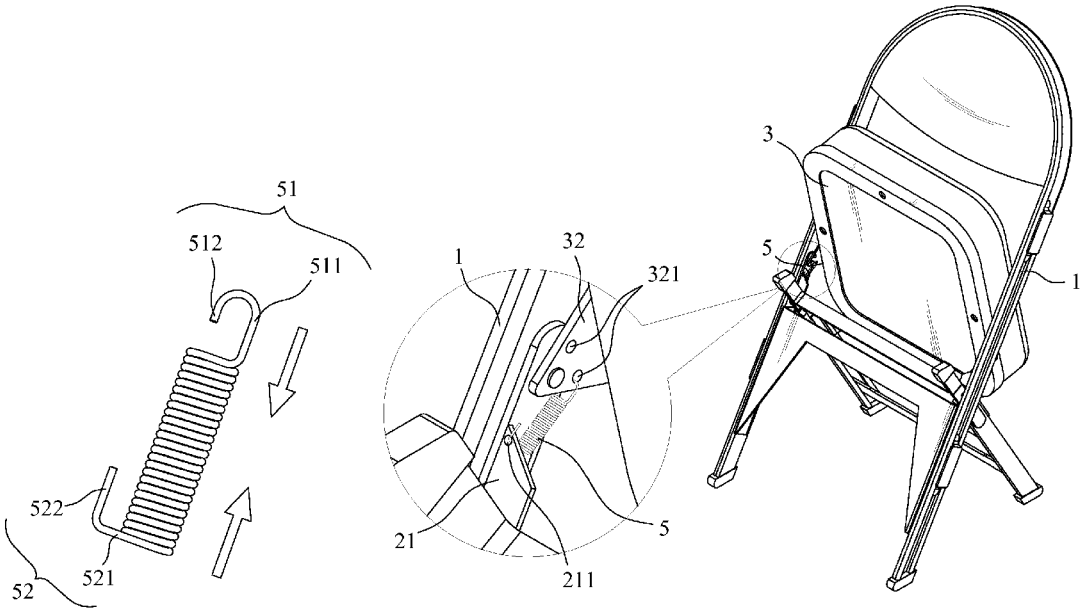
FIG. 2 is a front perspective view showing the portable chair according to the present invention in a folded state.
Figure 2A:
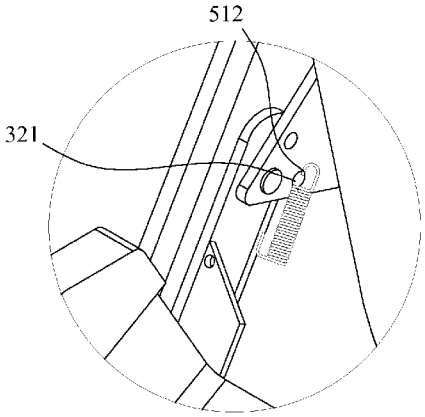
FIGS. 2A-2D are schematic views illustrating the steps of the assembly of a tension spring according to the present invention.
Figure 2B:
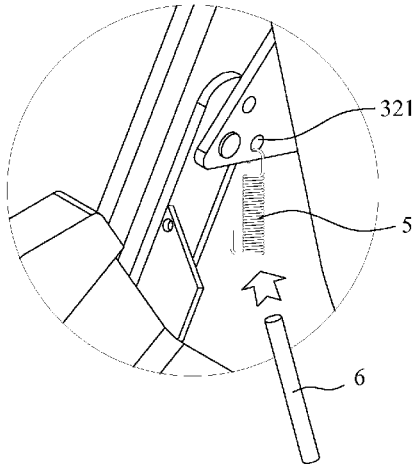
Figure 2C:
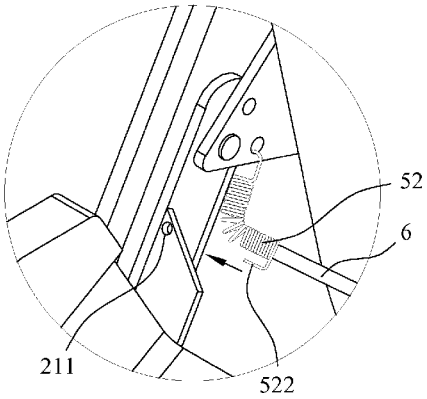
Figure 2D:
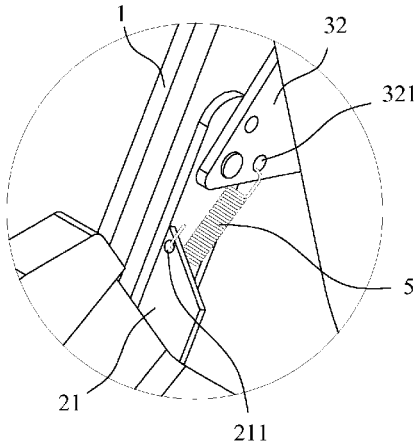

Referring to FIG. 2, the tension spring 5 is placed in a space that is defined between a mount bracket 32 provided on the seat frame 31 and a restricting flange 21 provided on the rear leg 2. The mount bracket 32 and the restricting flange 21 are located in planes that are in different orientations. The mount bracket 32 is oriented parallel to the front legs 1, and has a triangular shape. The mount bracket 32 comprises two first hanging holes 321 that have respective central axes perpendicular to the front legs 1. The two first hanging holes 321 are respectively placed adjacent to two side edges of the triangular shape of the mount bracket 32.

The restricting flange 21 is perpendicular to an inner surface of the front leg 1. The restricting flange 21 comprises a second hanging hole 211 that defines a central axis parallel to the front legs 1. In other words, the central axes of the first and second hanging holes 321 and 211 are different from one another.

The length of spring coils of the tension spring 5 is substantially equal to the length of the space in which the spring 5 is assembled. The tension spring 5 has a first hook element 51 and a second hook element 52. The first hook element 51 includes a first extension 511 that is parallel to a spring axis and extends from an edge of the spring coils toward a distal end, and a curved first hook 512 joined with a distal end of the first extension 511. The second hook element 52 includes a second extension 521 that extends from an edge of the spring coils in a direction perpendicular to the spring axis, and a second hook 522 that is joined perpendicular with a distal end of the second extension 521. The second hook 522 extends from the second extension toward the side of the spring coils and overlaps a portion of the spring coils. The first hook element 51 can be selectively connected with either of the two first hanging holes 321, and the second hook element 52 is connected with the second hanging hole 211.

Figure 8:
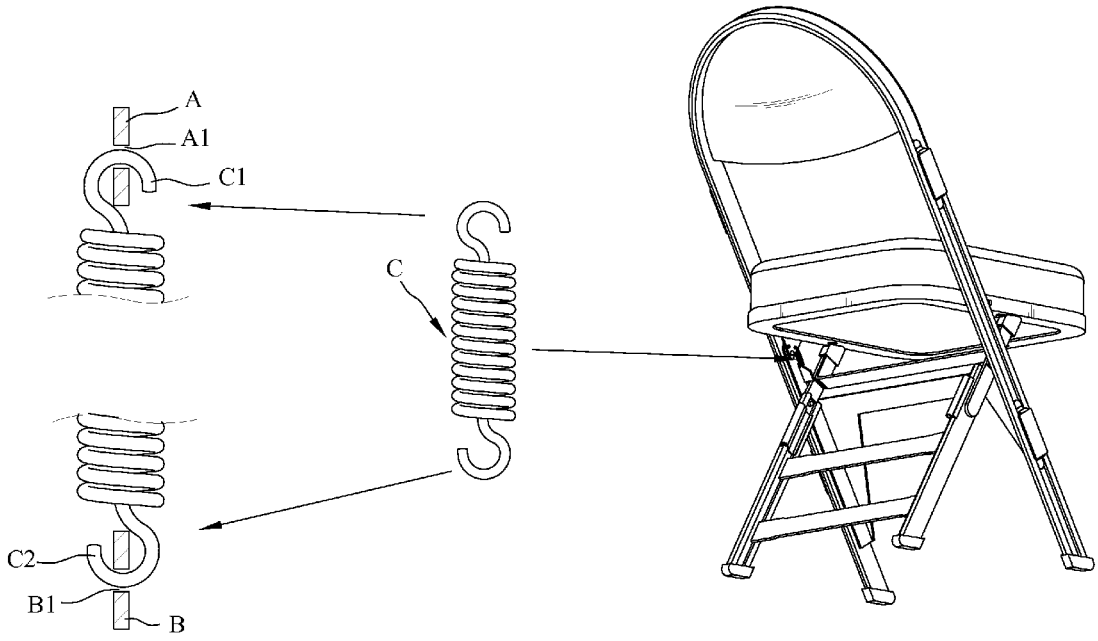
FIG. 8 (PRIOR ART)
FIG. 8 is a schematic view showing the assembly of a tension spring in a conventional portable chair.

FIGS. 2A-2D illustrate the steps of assembly of the tension spring 5. First, a first end of the tension spring 5 is positioned so that the first hook 512 is engaged with one of the first hanging holes 321. The tension spring 5 is thereby suspended from one of the first hanging holes 321. A rod 6 is then inserted into the tension spring 5, and the tension spring 5 is bent until the second hook 522 is aligned with the second hanging hole 211. The rod 6 then pushes the tension spring 5 forward such that the second hook 522 engages with the second hanging hole 211. After removal of the rod 6, the tension spring 5 can recover its initial state, completing the mount of the second hook element 52. Compared to the conventional spring having two rounded hooks (as shown in FIG. 8), the tension spring 5 according to the present invention allows convenient installation.

Figure 3A:
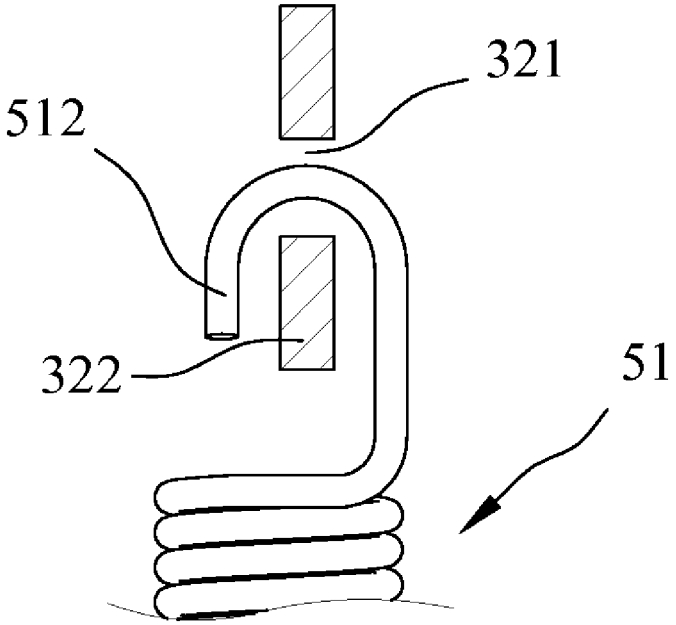
FIGS. 3A and 3B are cross-sectional views showing the engagement of the tension spring.
Figure 3B:
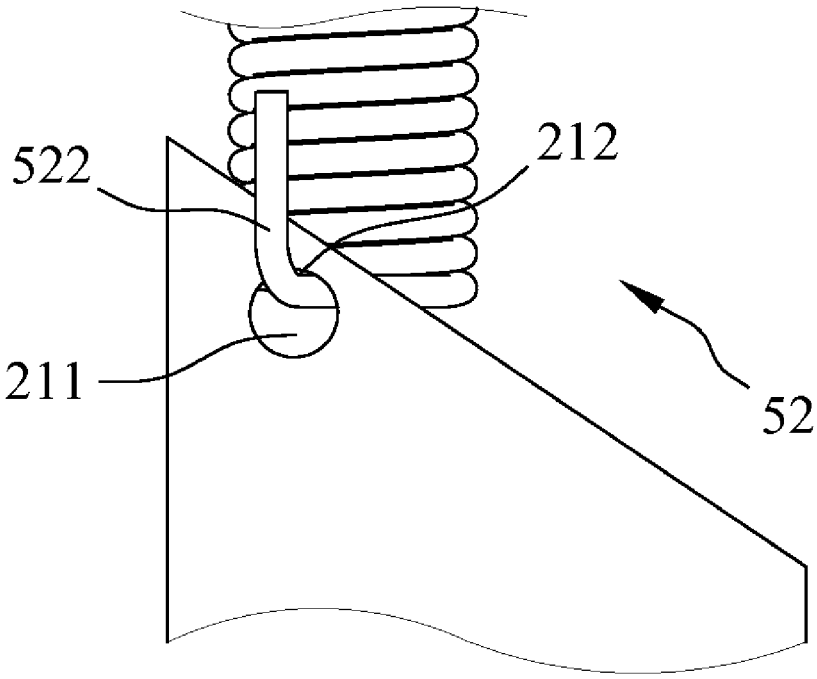

Referring to FIGS. 3A and 3B, once the first hook element 51 engages with the first hanging hole 321, the first hook 512 is parallel to a catch portion 322 of the first hanging hole 321. Once the second hook element 52 engages with the second hanging hole 211, the second hook 522 is parallel to a catch portion 212 of the second hanging hole 211. The catch portion 212 is retained on the side of the spring coils between the second hook 522 and the spring coils. As the first and second hooks 512 and 522 are respectively restrained by the catch portions 322 and 212, the two ends of the tension spring 5 cannot disengage from their respective hanging holes when the seat automatically folds upward. Accordingly, the tension spring 5 according to the present invention is more securely held in position than the conventional design (FIG. 8).

Figure 4:
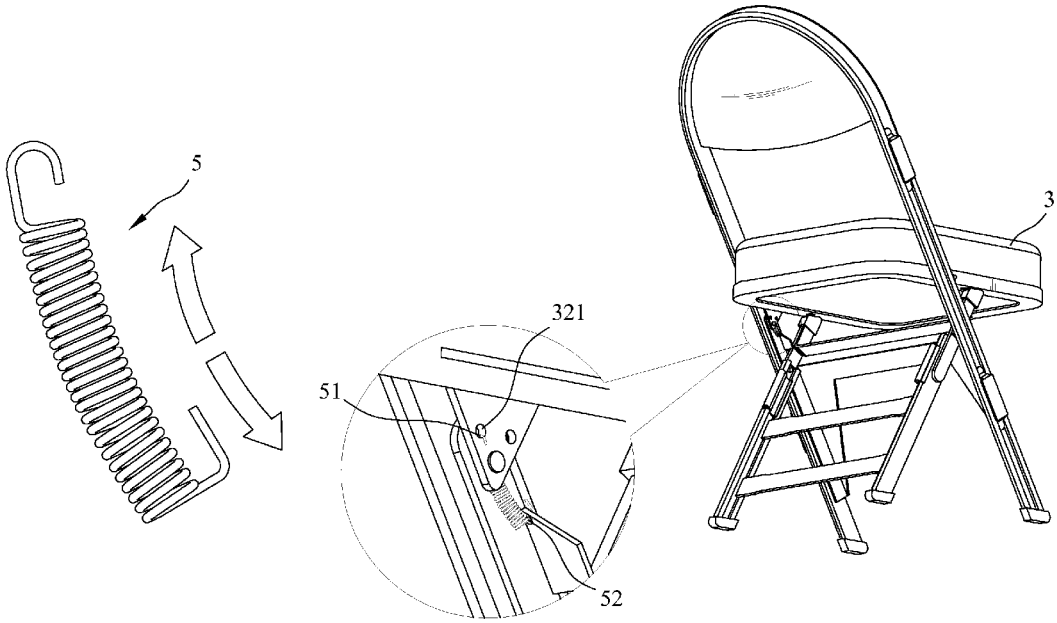
FIG. 4 illustrates the tension spring when the seat is unfolded.

With reference to FIG. 2, FIG. 4, when a user sits on the seat 3, the mount bracket 32 can rotate to unfold the seat 3 to a horizontal state. As the mount bracket 32 rotates, the engagement of the first and second hook elements 51 and 52 with the first and second hanging holes 321 and 211 causes the tension spring 5 to stretch. As described previously, because the length of the tension spring 5 is substantially equal to the length of the space in which the spring is placed (the distance between the first and second hanging holes 321 and 211), the tension spring 5 does not need to be stretched excessively to engage the two hook elements 51 and 52 with the hanging holes 321 and 211. As a result, the tension spring 5 does not stretch excessively when the seat 3 is unfolded. When the user stands up, the spring force applied to fold up the seat 3 is equivalent to the stretching tension. Because the spring is not excessively stretched during operation, fatigue and deformation of the spring can be reduced. Moreover, when the seat 3 is folded up, disengagement of the hook elements of the tension spring 5 due to the deformation of the spring 5 can be prevented. Accordingly, the service life of the spring 5 is prolonged.

Figure 5:
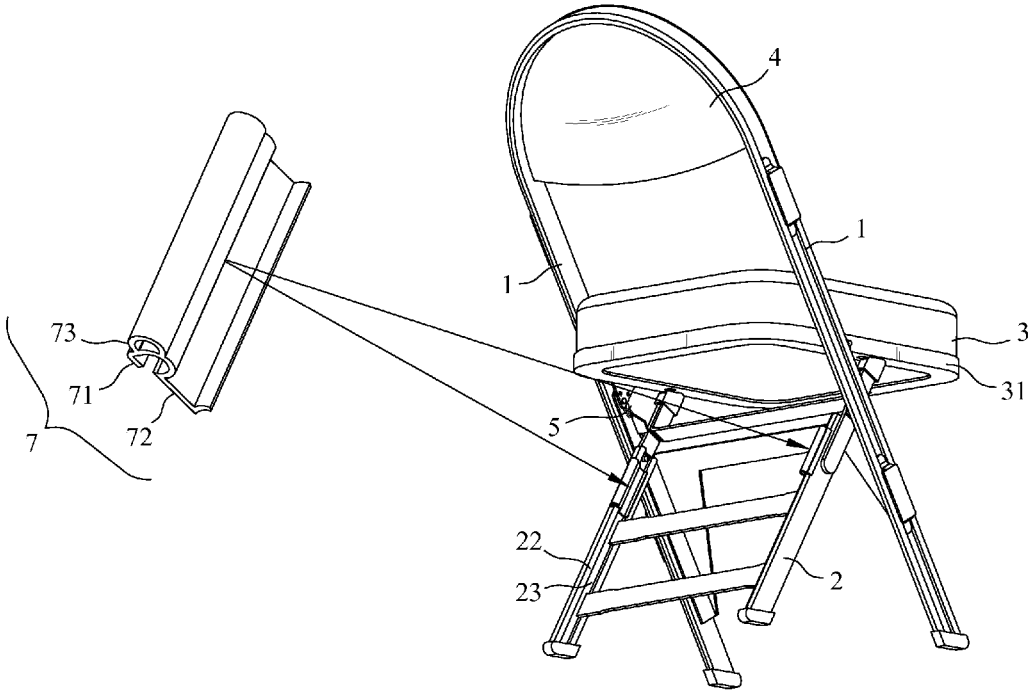
FIG. 5 is a perspective view showing a cushion mechanism according to the present invention.

Referring to FIG. 5, the cushion mechanism is assembled on the rear legs 2 so as to cushion collision of the seat frame 31 against the rear legs 2 when the seat 3 is folded up. The cushion mechanism comprises a cushion pad 7 that can be made of an elastic deformable material, such as PVC and rubber. The cushion pad 7, which may be integrally formed, comprises a retainer portion 71, an insert portion 72 and a cushion portion 73. The shape of the cushion pad 7 is designed to correspond to the shape of the rear leg 2. For example, the retainer portion 71 can be designed with a generally rounded shape to wrap around a round frame edge 22 of the rear leg 2. The retainer portion 71 has an opened side for engagement with the rear leg 2.

The insert portion 72 can be inserted into a groove 23 formed in the rear leg 2. The groove 23 and insert portion 72 can have complementary dove-tail shapes. In order to provide cushion effects, the cushion portion 73 is a hollow member that is disposed by the retainer portion 71. The retainer portion 71, insertion portion 72 and cushion portion 73 have similar lengths adapted to absorb collision of the seat frame 31.

Figures 6A, 6B, 6C:
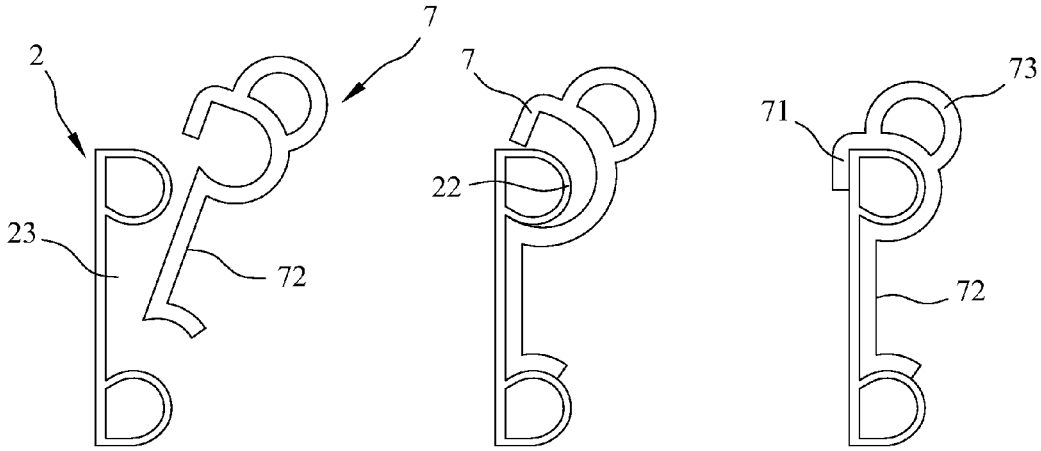
FIGS. 6A-6C are schematic views showing the steps of assembling a cushion pad on the rear leg.

FIGS. 6A-6C are schematic views illustrating the steps of installing the cushion pad 7 on the rear leg 2. First, the insert portion 72 is inserted into the groove 23. Then the retainer portion 71 can be wrapped around the frame edge 22 of the rear leg 2 through its opened side. The cushion portion 73 is located by the retainer portion 71.

Figure 7:
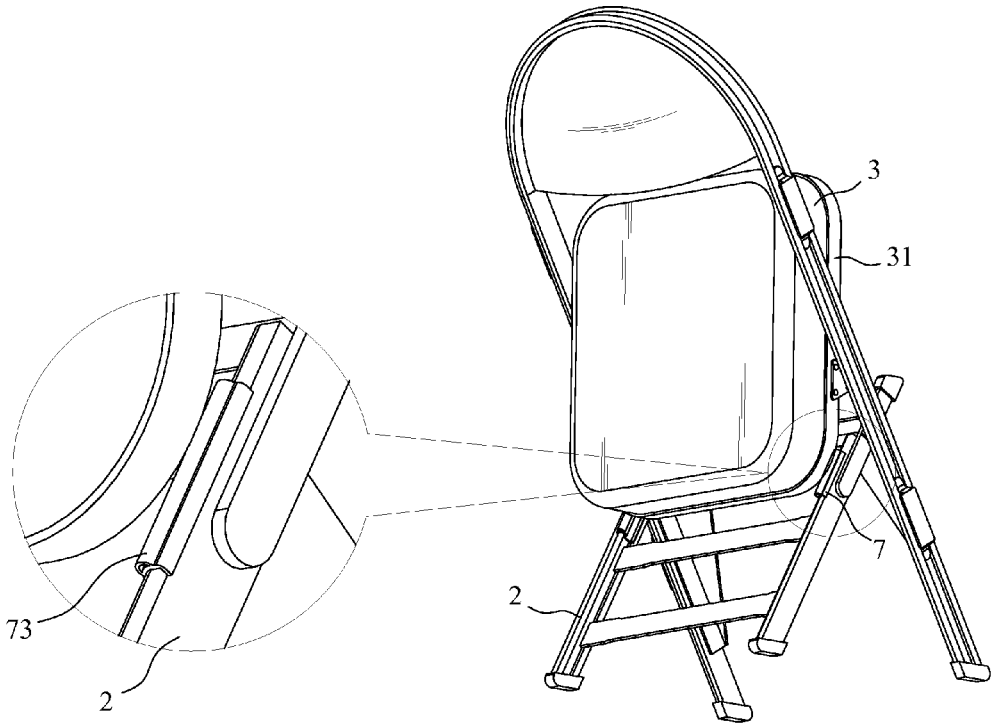
FIG. 7 is a schematic view showing the seat frame colliding against the cushion pad when the seat is folded up.

FIG. 7 is a schematic view illustrating the impact between the seat frame 31 and the cushion portion 73 on the rear leg 2 after the seat 3 is folded up. When the seat frame 31 collides against the cushion portion 73, the cushion portion 73 is squeezed, causing air to flow out through two open ends for absorbing vibration. Accordingly, when the seat frame 31 collides against the rear legs 2, bouncing of the seat 3 and associated vibration can be prevented. Moreover, noise induced by the collision of the steel-made seat frame 31 with the rear legs 2 can be prevented.

The foregoing description is intended to only provide illustrative ways of implementing the present invention, and should not be construed as limitations to the scope of the present invention. While the foregoing is directed to embodiments of the present invention, other and further embodiments of the invention may thus be devised without departing from the basic scope thereof, and the scope thereof is determined by the claims that follow.

What is claimed is:

1. A mechanism for self folding up and cushioning a seat of a portable chair, comprising:

a tension spring having a first hook element and a second hook element, wherein the first hook element includes a first extension, the first extension is parallel to a spring axis and extended from an edge of coils of the tension spring, a distal end of the first extension is extended to form a curved first hook, the second hook element includes a second extension, the second extension is extended from an edge of the coils in a direction perpendicular to the spring axis, a distal end of the second extension is extended toward one side of the coils of the tension spring to overlap a portion of the coils and form a second hook perpendicular to the second extension, the tension spring is assembled in a space between a mount bracket of the seat and a restricting flange provided on a rear leg of the portable chair, a length of the tension spring is substantially equal to a length of a space in which the tension spring is assembled; and a cushioning pad including a retainer portion, an insert portion and a cushion portion, wherein the retainer portion has an opened side for engagement with the rear leg, the cushion portion has a hollow member disposed by the retainer portion, the retainer portion is wrapped around a frame edge of the rear leg, the insert portion is inserted into a groove of the rear leg, whereby a frame of the seat is able to collide against the cushion portion when the seat is folded up by the tension spring so that noise and vibration are reduced.

2. The mechanism of claim 1, wherein the mount bracket and the restricting flange are disposed in different orientations.

3. The mechanism of claim 1, wherein the mount bracket has a first hanging hole that has a central axis perpendicular to a front leg of the portable chair, and the restricting flange has a second hanging hole that has a central axis parallel to the front leg, the first and second hook elements of the tension spring are respectively engaged with the first and second hanging holes.

4. The mechanism of claim 1, wherein the mount bracket is formed with a triangular shape, and has two first hanging holes adjacent to two sides of the triangular shape that have respective central axes perpendicular to a front leg of the portable chair, and the first hook element is adapted to selectively engage with either of the two first hanging holes.

5. The mechanism of claim 3, wherein after the first hook element is engaged with the first hanging hole, the tension spring is bent so as to align and engage the second hook element with the second hanging hole.

6. The mechanism of claim 3, wherein after the first hook is engaged with the first hanging hole, the first hook is parallel to a catch portion of the first hanging hole, and after the second hook is engaged with the second hanging hole, the second hook is parallel to a catch portion of the second hanging hole with the catch portion of the second hanging hole retained between the second hook and the overlapped portion of the coils.

7. The mechanism of claim 1, wherein the frame edge has a round shape and the groove has a dove-tail shape, the retainer portion has a shape corresponding to the shape of the frame edge, and the insertion portion has a shape corresponding to the shape of the groove.

8. The mechanism of claim 1, wherein the cushion pad is made of an elastic material.

9. The mechanism of claim 8, wherein the cushion pad is made of PVC.

10. The mechanism of claim 1, wherein the retainer portion, the insert portion and the cushion portion have the same lengths.

11. A mechanism for self folding up and cushioning a seat of a portable chair, comprising:

a tension spring having a first hook element and a second hook element, wherein the first hook element includes a first extension, the first extension is parallel to a spring axis and extended from an edge of coils of the tension spring, a distal end of the first extension is extended to form a curved first hook, the second hook element includes a second extension, the second extension is extended from an edge of the coils in a direction perpendicular to the spring axis, a distal end of the second extension is extended to form a second hook perpendicular to the second extension, the tension spring is assembled in a space between a mount bracket of the seat and a restricting flange provided on a rear leg of the portable chair, a length of the tension spring is substantially equal to a length of a space in which the tension spring is assembled; and a cushioning pad including a retainer portion, an insert portion and a cushion portion, wherein the retainer portion has an opened side for engagement with the rear leg, the cushion portion has a hollow member disposed by the retainer portion, the retainer portion is wrapped around a frame edge of the rear leg, the insert portion is inserted into a groove of the rear leg, whereby a frame of the seat is able to collide against the cushion portion when the seat is folded up by the tension spring so that noise and vibration are reduced;

wherein the frame edge has a round shape and the groove has a dove-tail shape, the retainer portion has a shape corresponding to the shape of the frame edge, and the insertion portion has a shape corresponding to the shape of the groove.

* * * * *